US008302449B2

(12) United States Patent
Mishima

(10) Patent No.: US 8,302,449 B2
(45) Date of Patent: Nov. 6, 2012

(54) CLOSING METHOD AND CLOSING MACHINE

(75) Inventor: Keisuke Mishima, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 805 days.

(21) Appl. No.: 11/887,452

(22) PCT Filed: Mar. 30, 2006

(86) PCT No.: PCT/JP2006/307269

§ 371 (c)(1),
(2), (4) Date: Jun. 24, 2009

(87) PCT Pub. No.: WO2006/107090

PCT Pub. Date: Oct. 12, 2006

(65) Prior Publication Data

US 2009/0293575 A1 Dec. 3, 2009

(30) Foreign Application Priority Data

Mar. 31, 2005 (JP) ..... 2005-101833

(51) Int. Cl.
*B23P 11/00* (2006.01)
*B21D 41/04* (2006.01)

(52) U.S. Cl. ..... 72/370.13; 72/82; 72/112; 72/115; 72/125; 72/379.4; 72/419; 72/421

(58) Field of Classification Search ..... 72/38, 69, 72/78, 80, 82, 84, 85, 96, 100, 112, 115, 72/125, 370.1, 370.12, 370.13, 379, 419, 72/421

See application file for complete search history.

(56) References Cited

U.S. PATENT DOCUMENTS

| | | | | | |
|---|---|---|---|---|---|
| 2,284,210 | A * | 5/1942 | Johnson | 72/370.12 |
| 2,421,629 | A * | 6/1947 | Langos | 72/370.02 |
| 2,971,554 | A * | 2/1961 | Knox | 72/370.12 |
| 3,475,786 | A * | 11/1969 | Pearson | 72/370.12 |
| 6,386,010 | B1 | 5/2002 | Irie et al. | |
| 6,742,236 | B1 | 6/2004 | Dion et al. | |
| 7,022,932 | B2 * | 4/2006 | Hatakeyama et al. | 228/173.4 |
| 7,775,077 | B2 * | 8/2010 | Mishima et al. | 72/370.12 |
| 7,854,156 | B2 * | 12/2010 | Tsuda et al. | 72/82 |
| 8,117,881 | B2 * | 2/2012 | Mishima et al. | 72/370.13 |
| 8,132,438 | B2 * | 3/2012 | Mishima | 72/370.12 |
| 2003/0154600 | A1 | 8/2003 | Umeda et al. | |

FOREIGN PATENT DOCUMENTS

| | | | |
|---|---|---|---|
| GB | 2278898 | A | 12/1994 |
| JP | 04-094827 | A | 3/1992 |
| JP | 2002-153930 | | 5/2002 |
| JP | 2003-509181 | | 3/2003 |
| JP | 2003-200241 | | 7/2003 |
| JP | 2004-344903 | A | 12/2004 |
| WO | WO-01/21338 | A1 | 3/2001 |
| WO | WO-03/092925 | A1 | 11/2003 |

* cited by examiner

*Primary Examiner* — David B Jones
(74) *Attorney, Agent, or Firm* — Rabin & Berdo, P.C.

(57) ABSTRACT

A closing machine (1) for closing an open end of a work piece (9) by pressing a die (4) against the work piece (9) rotating about an axial center comprises a chuck spindle (20) that drives the work piece (9) to rotate, a chuck sliding support mechanism (62) that supports the work piece (9) so that the work piece (9) can move in a rotary axis direction relative to the chuck spindle (20), and a thrust stopper (6) that causes an end portion of the work piece (9), which is moved by a load applied from the die (4), to abut against the thrust stopper (6) such that the work piece (9) is supported in a predetermined closing position.

4 Claims, 6 Drawing Sheets

CLOSING METHOD AND CLOSING MACHINE

FIELD OF THE INVENTION

This invention relates to an improvement in a closing method and a closing machine for closing an open end of a metal pipe material.

BACKGROUND OF THE INVENTION

In a closing method, a work piece constituted by a metal pipe material is rotated and a die is pressed against the work piece while the work piece is heated. Thus, the work piece undergoes plastic deformation as it gradually approaches the die.

A closing machine used in the closing operation comprises an outer diameter chuck that grips an outer peripheral surface of the work piece, and a chuck spindle that drives the outer diameter chuck to rotate together with the work piece. The outer diameter chuck grips the work piece, which is introduced via a conveyor or the like, and drives the work piece to rotate in a predetermined position. The closing machine presses a rotating die against the rotating work piece using the outer diameter chuck, and as a result, the work piece is closed into a predetermined shape corresponding to the die.

The closing method and closing machine described above are disclosed in JP2002-153930.

However, in this conventional closing machine, the processing precision of the work piece is determined according to the positional precision with which the chuck spindle holds the work piece, and therefore, if variation occurs in the positional precision with which the chuck spindle holds the work piece, the processing precision of the work piece deteriorates, making it difficult to close the work piece into a predetermined shape.

It is therefore an object of this invention to provide a closing method and a closing machine capable of improving the processing precision of a work piece without being affected by the positional precision with which a chuck spindle holds the work piece.

SUMMARY OF THE INVENTION

This invention provides a closing method for closing an open end of a work piece by pressing a die against the work piece rotating about an axial center, characterized by driving the work piece to rotate using a chuck spindle, supporting the rotating work piece using a chuck sliding support mechanism so that the rotating work piece can move in a rotary axis direction thereof, and causing the work piece, which is moved by a load applied from the die, to abut against a thrust stopper such that the work piece is supported in a predetermined closing position.

Further, this invention provides a closing machine for closing an open end of a work piece by pressing a die against the work piece rotating about an axial center, characterized by a chuck spindle that drives the work piece to rotate, a chuck sliding support mechanism that supports the work piece so that the work piece can move in a rotary axis direction thereof, and a thrust stopper that causes the work piece, which is moved by a load applied from the die, to abut against the thrust stopper such that the work piece is supported in a predetermined closing position.

According to this invention, during a closing operation, the work piece is closed by the die while abutting against the thrust stopper so as to be supported in the predetermined closing position. Hence, even if irregularities occur in the positional precision with which the chuck spindle holds the work piece, the processing position of the work piece is kept constant via the thrust stopper, and therefore the work piece can be closed into a predetermined shape. As a result, the processing precision of the work piece can be enhanced without being affected by the positional precision with which the chuck spindle holds the work piece.

BRIEF DESCRIPTION OF THE DRAWINGS

FIG. 6 is a sectional view of a thrust stopper and so on.

DESCRIPTION OF THE PREFERRED EMBODIMENTS

This invention will now be described in further detail with reference to the attached drawings.

Figure 1:
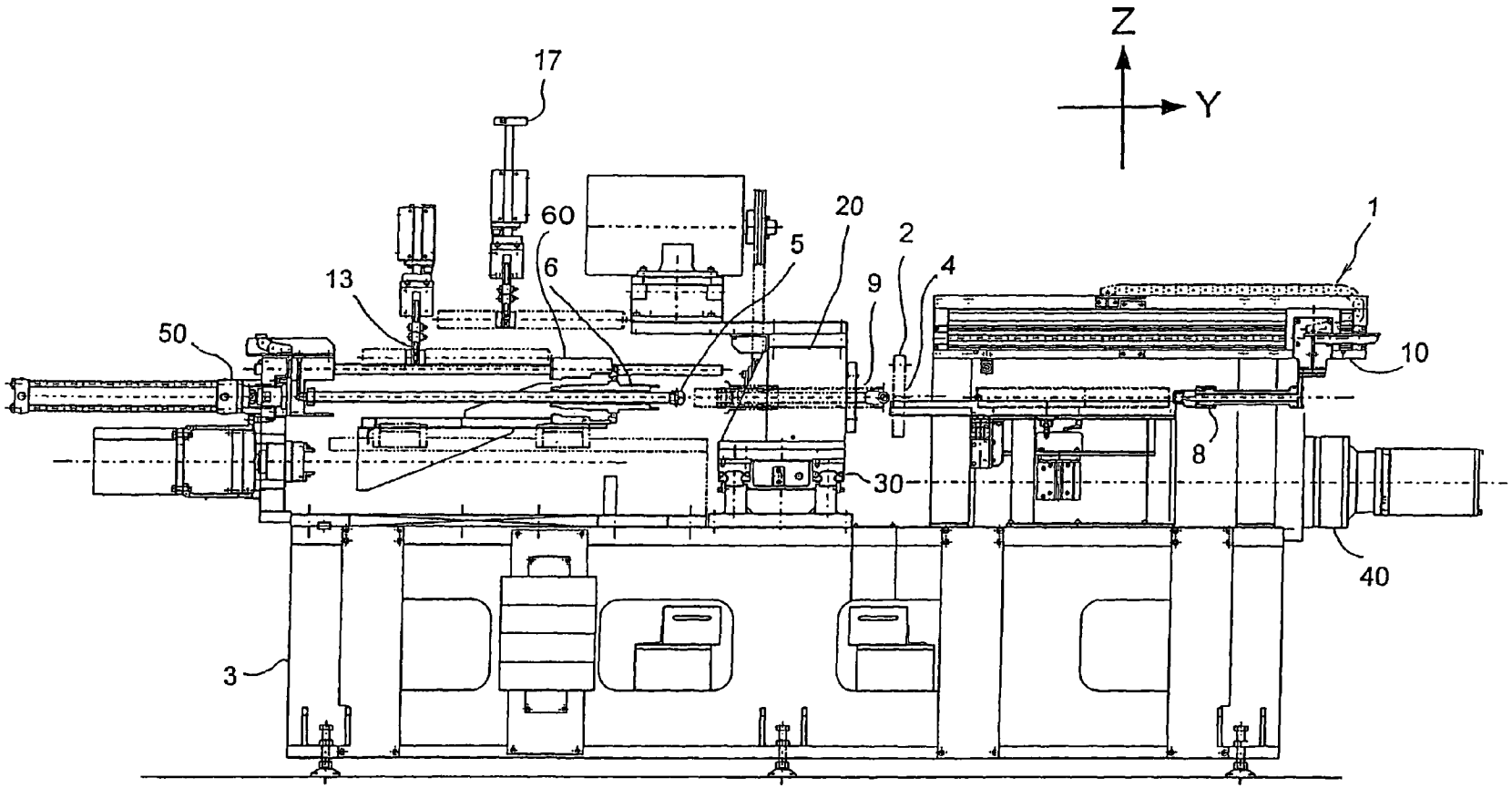
FIG. 1 is a side view of a closing machine, illustrating an embodiment of this invention.
Figure 2:
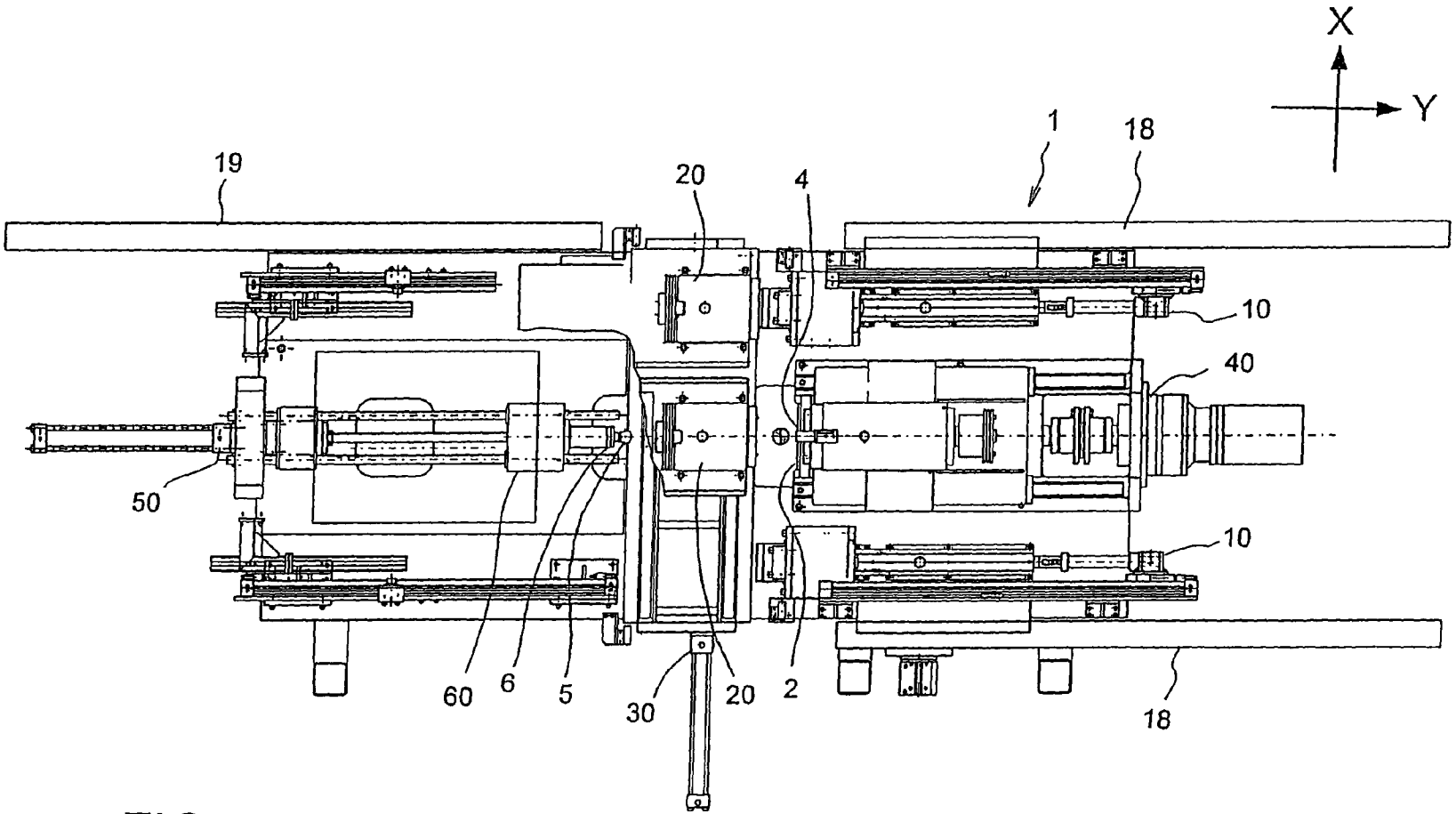
FIG. 2 is a plan view of the closing machine.
Figure 3:
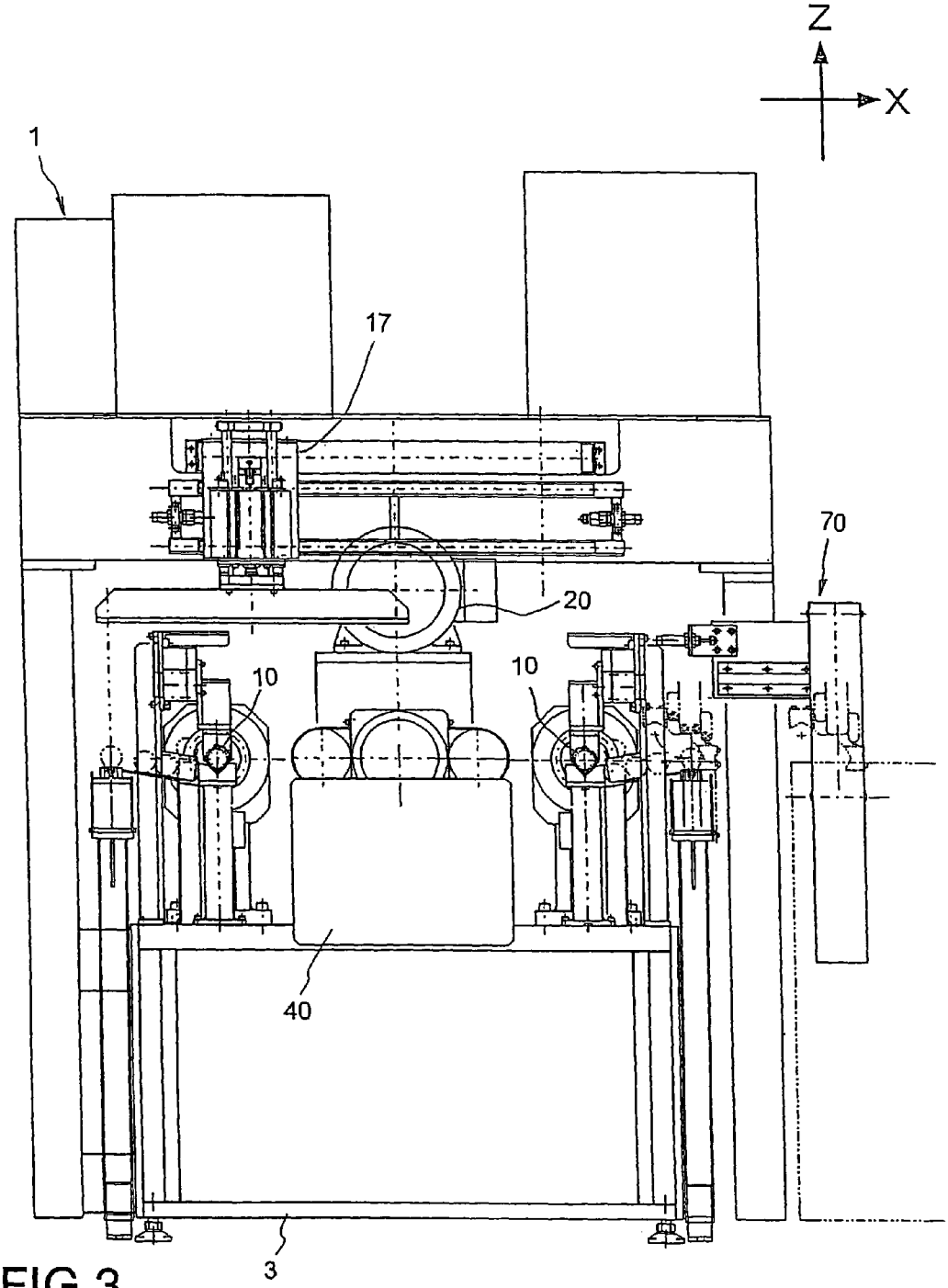
FIG. 3 is a front view of the closing machine.

FIGS. 1 to 3 show the overall constitution of a closing machine 1. In FIGS. 1 to 3, three axes, namely X, Y, and Z, are set orthogonal to each other. It is assumed that the X axis extends in a substantially horizontal lateral direction, the Y axis extends in a substantially horizontal front-rear direction, and the Z axis extends in a substantially vertical direction. The overall constitution of the closing machine 1 will now be described.

Two chuck spindles 20 which drive a work piece 9 to rotate about its axial center, and a single die driving device 40 which drives a die 4, are provided in a central portion of the closing machine 1. The chuck spindles 20 perform a reciprocating motion in the X axis direction relative to a pedestal 3 via a chuck spindle moving device 30, to be described later, thereby moving alternately to the central portion of the closing machine 1 so as to bring the work piece 9 face to face with the die 4.

The closing machine 1 performs a closing, operation to close an open end of the work piece 9 by heating the work piece 9, which is constituted by a metal pipe material, using a high-frequency heating device 2, and pressing the die 4 against the rotating work piece 9 such that the work piece 9 undergoes plastic deformation.

A thrust stopper moving device 60, which is positioned in front of the chuck spindle 20 for closing the work piece 9 so as to support an end portion of the work piece 9, and a core moving device 50, which moves a core 5 inside the work piece 9, are provided in the central portion of the closing machine 1.

A pair of conveyors 18 and a work piece introducing device 10 are provided respectively on the left and right rear portions of the working machine 1. The work piece 9 is conveyed forward in the Y axis direction by each of the conveyors 18 and then conveyed forward in the Y axis direction by each of the work piece introducing devices 10, which are capable of movement in the Y axis direction. Thus, the work piece 9 is introduced into and gripped by the respective left and right chuck spindles 20.

While one of the chuck spindles 20 is positioned in the central portion of the working machine 1 during a closing operation, the other chuck spindle 20 is positioned on either the left or right end portion of the closing machine 1 so as to receive the work piece 9 conveyed by the respective work piece introducing devices 10.

A discharge device 17 for discharging the work piece 9 following the closing operation is provided at the front portion of the closing machine 1. The discharge device 17 causes a hand 13 gripping the work piece 9 to reciprocate in the X axis direction relative to the pedestal 3 such that the work piece 9, which is pushed out from the left and right chuck spindles 20, is conveyed to a conveyor 19 disposed on the right-hand front portion of the closing machine 1.

Once the closing operation is complete, the work piece 9, which is at a high temperature of 1000° C. or more, is conveyed to a cooling device 70 (see FIG. 3) by the conveyor 19 and cooled by the cooling device 70. The cooling device 70 is provided on the front right side of the closing machine 1.

FIGS. 4A to 4G show a series of processes performed by the closing machine 1 to close the work piece 9. Each process of this closing method will now be described in sequence.

Figure 4A:
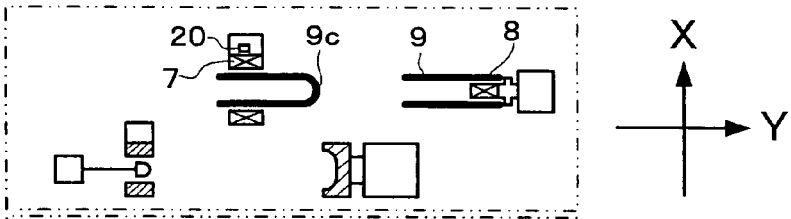
FIGS. 4A-4H are views showing closing processes.

Referring to FIG. 4A, an inner diameter chuck 8 of the work piece introducing device 10 is inserted into the work piece 9 such that the inner diameter chuck 8 grips the inner peripheral surface of the work piece 9.

Figure 4B:
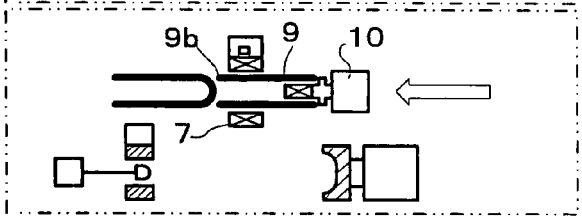

Referring to FIG. 4B, the work piece introducing device 10 causes the inner diameter chuck 8 to advance in the Y axis direction such that the work piece 9 is inserted into an outer diameter chuck 7 of the chuck spindle 20. Thus, the outer diameter chuck 7 grips the outer peripheral surface of the work piece 9.

Figure 4C:
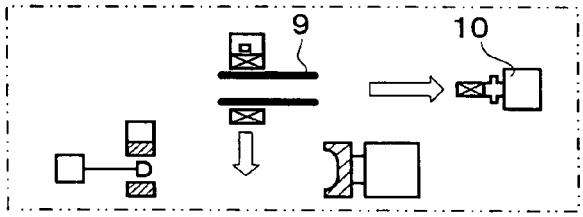

Referring to FIG. 4C, the work piece introducing device 10 causes the inner diameter chuck 8 to retreat in the Y axis direction such that the inner diameter chuck 8 is extracted from the work piece 9. Next, the chuck spindle moving device 30 moves the chuck spindle 20 in the X axis direction until the work piece 9 is stopped in an operation position facing the die 4.

Figure 4D:
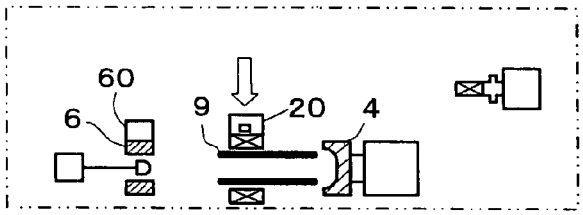

Referring to FIG. 4D, the thrust stopper moving device 60 moves a thrust stopper 6 to a thrust operation reference position supporting a base end portion 9*b* of the work piece 9.

Figure 4E:
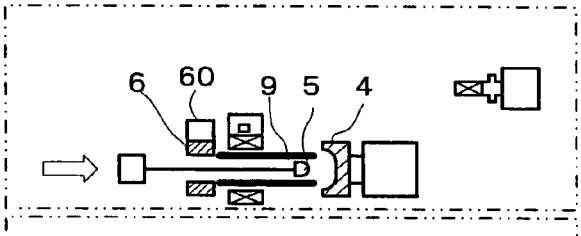

Referring to FIG. 4E, the core moving device 50 introduces the core 5 into the inside of the work piece 9.

Figure 4F:
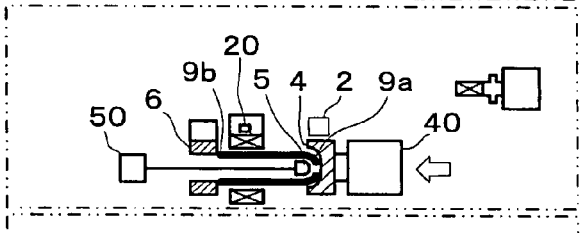

Referring to FIG. 4F, the chuck spindle 20 drives the work piece 9 and the core 5 to rotate. Meanwhile, the die 4 is pressed against the heated work piece 9 by the die driving device 40. Thus, a tip end portion 9*a* of the work piece 9 is steadily reduced in diameter between the die 4 and the core 5 such that finally, the tip end portion 9*a* of the work piece 9 closes to form a bottom portion 9*c*.

Figure 4G:
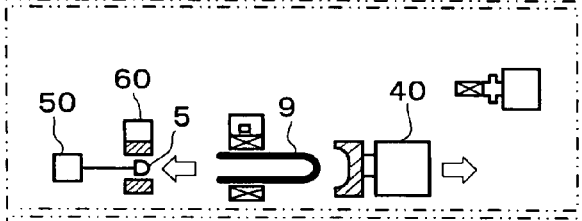

Referring to FIG. 4G, the die driving device 40 moves the die 4 rearward in the Y axis direction away from the work piece 9. Meanwhile, the thrust stopper moving device 60 moves the thrust stopper 6 forward in the Y axis direction away from the thrust operation reference position, and the core moving device 50 removes the core 5 from the inside of the work piece 9.

To close another work piece 9 thereafter, the chuck spindle moving device 30 moves the chuck spindle 20 in the X axis direction such that the work piece 9 faces the inner diameter chuck 8, as shown in FIG. 4A. Then, as shown in FIG. 4B, the work piece introducing device 10 causes the inner diameter chuck 8 to advance in the Y axis direction such that the base end portion 9*b* of the unclosed work piece 9 abuts against the bottom portion 9*c* of the closed work piece 9, and thus the closed work piece 9 is pushed out of the outer diameter chuck 7.

Figure 4H:
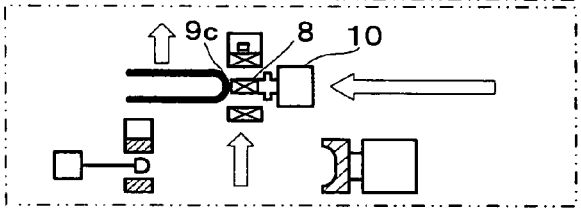

To terminate the closing operation of the work piece 9, the work piece introducing device 10 causes the inner diameter chuck 8 to advance in the Y axis direction, as shown in FIG. 4H, such that the inner diameter chuck 8 abuts against the bottom portion 9*c* of the closed work piece 9, and thus the closed work piece 9 is pushed out of the outer diameter chuck 7.

The overall constitution of the closing machine 1 was described above.

Next, the constitution of the chuck spindle 20 shown in FIG. 5 will be described.

The chuck spindle 20 grips the outer peripheral surface of the work piece 9, and comprises a chuck sliding support mechanism 62 which supports the rotating work piece 9 so that the work piece 9 can move in a rotary axis direction (Y axis direction) relative to the pedestal 3.

The outer diameter chuck 7 comprises a cylindrical chuck case 221, a plurality of chuck members 222 that are stored in the chuck case 221 and grip the outer peripheral surface of the work piece 9, a cam member 224 that moves in the rotary axis direction (Y axis direction) to move the chuck members 222 in a rotary diameter direction, a spring 223 that biases the cam member 224 forward (to the left side in FIG. 5) in the Y axis direction, and a hydraulic plunger that moves the cam member 224 rearward (to the right side in FIG. 5) in the Y axis direction against the biasing force of the spring 223.

When a control oil pressure received by the plunger is low, the cam member 224 is moved forward (to the left side in FIG. 5) in the Y axis direction by the biasing force of the spring 223, and at the same time, the chuck members 222 move to the inside of the rotary diameter direction such that each chuck member 222 grips the outer peripheral surface of the work piece 9.

When the control oil pressure rises such that the plunger moves the cam member 224 rearward (to the right side in FIG. 5) in the Y axis direction against the biasing force of the spring 223, the cam member 224 moves the chuck members 222 to the outside of the rotary diameter direction, whereby the chuck members 222 release the work piece 9.

The chuck sliding support mechanism 62 comprises a bearing case 231 that supports the chuck case 221 of the outer diameter chuck 7 rotatably, a support case 241 that supports the bearing case 231 so that the bearing case 231 can move in the rotary axis direction of the work piece 9, and a return spring 251 that biases the bearing case 231 toward the die 4 side.

The chuck case 221 is supported rotatably on the bearing case 231 via a pair of angular bearings 232. The angular bearings 232 are interposed between the chuck case 221 and bearing case 231 such that the respective back surfaces thereof are joined, and support a radial load and a thrust load acting on the chuck case 221.

The chuck case 221 is supported rotatably on the support case 241 via a roller bearing 242. The radial roller type roller bearing 242 supports the radial load acting on the chuck case 221, but does not support the thrust load.

A pulley 213 is connected to an end portion of the chuck case 221 projecting from the bearing case 231 and the support case 241. The rotation of a motor 210 is transmitted to the chuck case 221 via a pulley 211, a belt 212, and the pulley 213, and thus the outer diameter chuck 7 is driven to rotate by the motor 210.

The support case 241 has a cylindrical surface-shaped cylinder wall 242, and the cylindrical bearing case 231 is stored on the cylinder wall 242 so as to be capable of sliding in the Y axis direction.

Seals 271, 272 are interposed between the support case 241 and the chuck case 221. Lubricating oil charged through an oil supply hole (not shown) is sealed between the support case 241 and chuck case 221 via the seals 271, 272. Thus, the sliding portion of the bearing case 231 relative to the support case 241 is lubricated, and a smooth operation is maintained.

A plurality of return springs 251 are interposed between the support case 241 and bearing case 231. The bearing case 231 is biased toward the die 4 side by the spring force of each return spring 251.

A plurality of rotation-stopping pins 261 are interposed between the support case 241 and bearing case 231. One end of each rotation-stopping pin 261 is buried in the bearing case 231, and the other end of each rotation-stopping pin 261 is inserted slidably into a hole 244 in the support case 241. Thus, the bearing case 231 is stopped from rotating relative to the support case 241.

Figure 6:
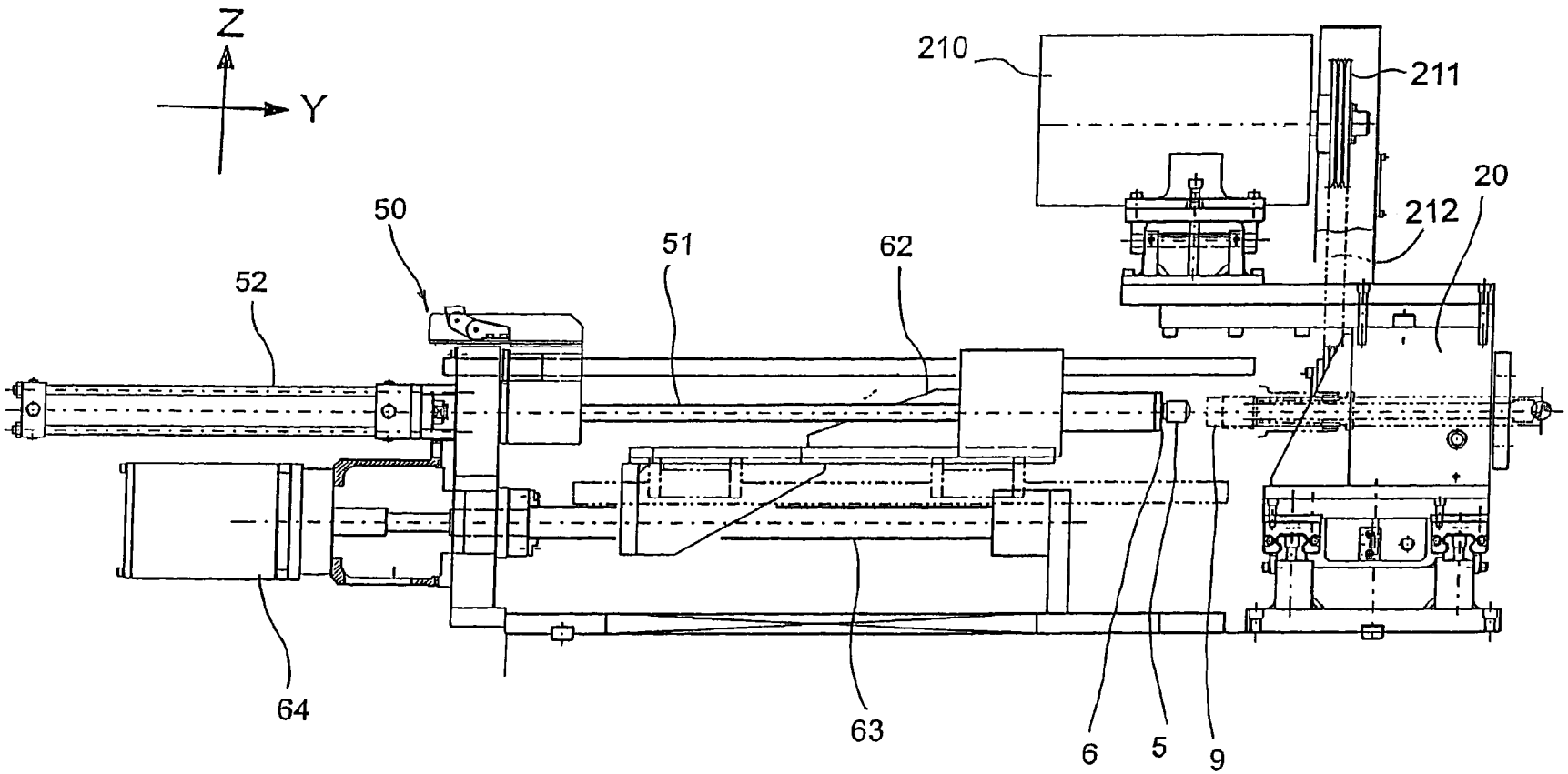

As shown in FIG. 6, the closing machine 1 comprises the thrust stopper 6, which supports a base end portion 9*b* of the work piece 9 abutting against it in a predetermined closing position. The tubular thrust stopper 6 is disposed on the rotary axis of the chuck spindle 20, and has a ring-shaped end surface against which the base end portion 9*b* of the work piece 9 abuts.

A rod 51 that supports the core 5 is inserted into the inside of the thrust stopper 6. The core moving device 50 moves the rod 51 in the axial direction by means of an expansion/contraction operation of an air cylinder 52, whereby the core 5 is inserted into the inside of the work piece 9.

The closing machine 1 comprises the thrust stopper moving device 60 which moves the thrust stopper 6 in the Y axis direction on the rotary axis of the chuck spindle 20.

The thrust stopper moving device 60 comprises a sliding table 62 that supports the thrust stopper 6 rotatably via a bearing (not shown), two guide rails 63 that support the sliding table 62 movably in the Y axis direction, and a hydraulic cylinder 64 that moves the sliding table 62 along the guide rails 63. The hydraulic cylinder 64 moves the thrust stopper 6 forward and backward in the Y axis direction in accordance with the output of a controller not shown in the figure, and stops the thrust stopper 6 in a standby position removed from the front of the work piece 9, and a thrust processing reference position abutting against the based end portion 9*b* of the work piece 9 during a closing operation.

In a closing method, the thrust stopper 6 is stopped in the thrust processing reference position prior to closing such that the thrust stopper 6 faces the work piece 9 with a gap 61 therebetween, and during the closing operation, the work piece 9 is moved in the rotary axis direction by a load F of the die 4, whereby the work piece 9 comes into contact with the thrust stopper 6 and is supported in a predetermined closing position.

The gap 61 is set at approximately several millimeters, for example, and the work piece 9 is moved in a stroke that is considerably larger than an amount of variation in the position in which the outer diameter chuck 7 holds the work piece 9.

In a process performed prior to the closing operation, the thrust stopper moving device 60 stops the thrust stopper 6 in the thrust processing reference position facing the rear end portion 9*b* of the work piece 9. At this time, as shown in the lower half portion of FIG. 5, the outer diameter chuck 7 is positioned frontward in the axial direction together with the work piece 9 due to the spring force of the return springs 251, and as a result, the work piece 9 faces the thrust stopper 6 via the gap 61.

Figure 5:
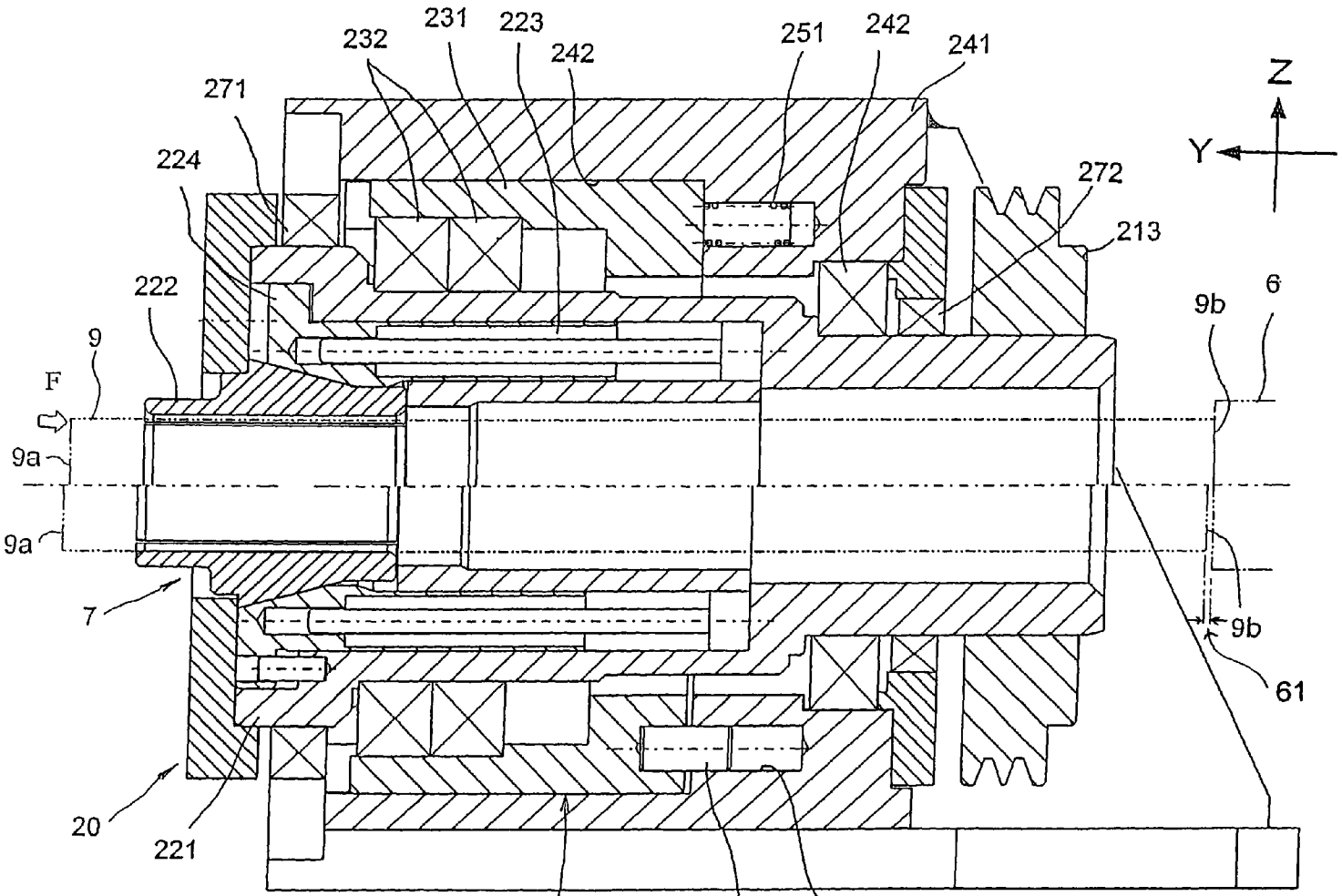
FIG. 5 is a side view of a chuck spindle moving device.

During the closing operation, as shown in the upper half portion of FIG. 5, the work piece 9 is moved in the axial direction by the load F of the die 4 that is pressed against the front end portion 9*a* thereof, while the rear end portion 9*b* thereof is supported so as to contact the thrust stopper 6. The thrust stopper 6 supports the work piece 9 in the predetermined closing position in the axial direction while rotating together with the work piece 9.

With the work piece 9 thus supported in the predetermined closing position in contact with the thrust stopper 6, the tip end portion 9*a* of the work piece 9 is gradually squeezed between the die 4 and the core 5 such that finally, the tip end portion 9*a* of the work piece 9 forms the closed bottom portion 9*c*.

Hence, even if irregularities occur in the positional precision with which the outer diameter chuck 7 holds the work piece 9, the processing position of the work piece 9 is kept constant via the thrust stopper 6, and therefore the work piece 9 can be closed into a predetermined shape. In other words, the processing precision of the work piece 9 can be enhanced without being affected by the positional precision with which the outer diameter chuck 7 holds the work piece 9.

The chuck sliding support mechanism 62 comprises the bearing case 231 that supports the outer diameter chuck 7 rotatably, the support case 241 that supports the bearing case 231 so that the bearing case 231 can slide in the rotary axis direction, and the return spring 251 that biases the bearing case 231 toward the die 4 side, and therefore, during the closing operation, the work piece 9 is moved in the rotary axis direction together with the bearing case 231 of the outer diameter chuck 7 by the load F of the die 4. The bearing case 231 of the outer diameter chuck 7 is supported so as to be capable of sliding in the rotary axis direction relative to the support case 241, and therefore the work piece 9 can be supported with enough rigidity to ensure that the core of the work piece 9 does not fluctuate.

The pulley 213 is connected to the outer diameter chuck 7, and the outer diameter chuck 7 is driven to rotate via the belt 212 that is wrapped around the pulley 213. Hence, even if the outer diameter chuck 7 moves in the rotary axis direction together with the work piece 9 during the closing operation, the circulation path of the belt 212 changes slightly such that the outer diameter chuck 7 can be driven to rotate smoothly.

The core 5 disposed on the inside of the work piece 9 during the closing operation, the rod 51 that supports the core 5, and the core moving device 50 that moves the core 5 in the rotary axis direction of the work piece 9 via the rod 51 are provided, and the thrust stopper 6 is formed in a tubular shape that is penetrated by the rod 51. Thus, the core 5 can be moved to the thrust stopper 6 regardless of its position.

INDUSTRIAL APPLICABILITY

The closing method and closing machine of this invention are not limited to a closing operation such as that described above, for closing an open end of a work piece, and may be used in a spinning operation to reduce the diameter of a work piece by pressing a die against the rotating work piece.

The invention claimed is:

1. A closing method for closing an open end of a work piece by pressing a die against the work piece rotating about a rotary axis, comprising:

driving the work piece to rotate using a chuck spindle;

supporting the rotating work piece using a chuck sliding support mechanism so that the rotating work piece can move in a direction of the rotary axis, the chuck sliding support mechanism comprising a bearing case that rotatably supports an outer chuck holding an outer periphery of the work piece, a support case that supports the bearing case so that the bearing case can slide in the direction of the rotary axis, and a return spring that biases the bearing case toward the die; and causing the work piece, which is moved by a load applied from the die, to abut against a thrust stopper to support the work piece in a predetermined closing position along the rotary axis.

2. A closing machine for closing an open end of a work piece by pressing a die against the work piece rotating about a rotary axis, comprising:

a chuck spindle that drives the work piece to rotate;

a chuck sliding support mechanism that supports the work piece so that the work piece can move in a direction of the rotary axis, the chuck sliding support mechanism comprising a bearing case that rotatably supports an outer chuck holding an outer periphery of the work piece, a support case that supports the bearing case so that the bearing case can slide in the direction of the rotary axis, and a return spring that biases the bearing case toward the die; and a thrust stopper that abuts against the work piece, which is moved by a load applied from the die, to support the work piece in a predetermined closing position along the rotary axis.

3. The closing machine as defined in claim 2, wherein a pulley is connected to the outer chuck holding the outer periphery of the work piece, and the outer chuck is driven to rotate via a belt that is wrapped around the pulley.

4. The closing machine as defined in claim 2, further comprising:

a core disposed on an inside of the work piece;

a rod that supports the core; and a core moving device that moves the core in the direction of the rotary axis via the rod, wherein the thrust stopper is formed in a tubular shape that is penetrated by the rod.

* * * * *